United States Patent [19]

Friedman

[11] 4,134,495

[45] Jan. 16, 1979

[54] SINGLE SIZE DISPLAY CARTON FOR PACKAGING EITHER A TAPE CASSETTE OR TAPE CARTRIDGE

[75] Inventor: Herbert Friedman, New York, N.Y.

[73] Assignee: Brugail Licensing Company, Great Neck, N.Y.

[21] Appl. No.: 804,001

[22] Filed: Jun. 6, 1977

[51] Int. Cl.[2] ..... B65D 85/672

[52] U.S. Cl. ..... 206/387; 206/45.14; 229/27

[58] Field of Search ..... 229/15, 27; 206/45.14, 206/387

[56] References Cited

U.S. PATENT DOCUMENTS

| | | | |
|---|---|---|---|
| 2,970,738 | 2/1961 | Strange | 229/27 |
| 3,156,351 | 11/1964 | Small | 229/27 |
| 3,642,273 | 2/1972 | Baglio | 229/27 |
| 3,682,297 | 8/1972 | Austin et al. | 206/387 |
| 3,698,544 | 10/1972 | Growney | 206/45.14 |
| 3,744,703 | 7/1973 | Mortenson | 206/387 |
| 3,780,931 | 12/1973 | Hanson | 229/27 |
| 3,835,987 | 9/1974 | Growney | 206/45.14 |
| 3,869,062 | 3/1975 | Jaeschke | 229/27 |

*Primary Examiner*—Stephen P. Garbe
*Assistant Examiner*—Bruce H. Bernstein
*Attorney, Agent, or Firm*—Darby & Darby

[57] ABSTRACT

A carton for packaging an object such as a tape cassette or an 8-track tape cartridge includes bottom, top, side and end walls which form an outer carton, and an inner carton portion formed within the outer carton for preventing movement of the contained object in first or lateral horizontal directions, in a second or longitudinal horizontal direction and in a vertical direction. In a preferred embodiment, the inner carton portion is formed from a flap hingedly connected to an outer wall. The flap is folded to form an inner horizontal wall within the outer carton and is further folded to form an inner vertical wall within the outer carton, thereby defining a first compartment beneath the inner vertical wall and a second compartment on the other side of the inner vertical wall. Two side-by-side tabs are formed on the flap adjacent the inner vertical wall. The first tab is folded along the same fold line separating the horizontal and vertical inner walls at an angle relative to each of the inner walls so that it extends into the first compartment and abuts a portion of the object contained within the first compartment thereby preventing movement in a second horizontal direction. The second tab extends in an opposite direction from the first tab into the second compartment so that it abuts a portion of the object contained within the second compartment, thereby preventing movement in a second horizontal direction. The sizes of the two compartments are different so that the carton is adapted to package one of two different size objects.

8 Claims, 7 Drawing Figures

FIG. 1
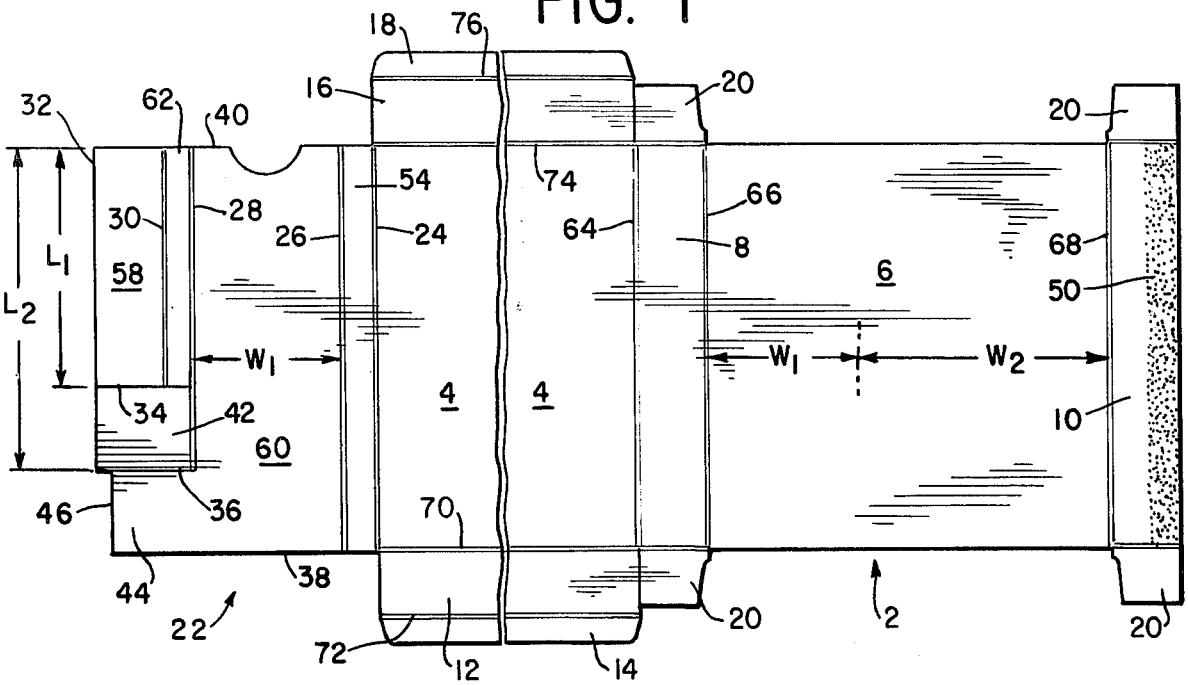
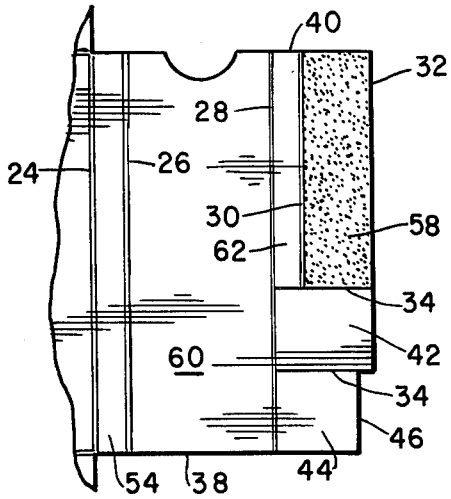
FIG. 2
FIG. 3
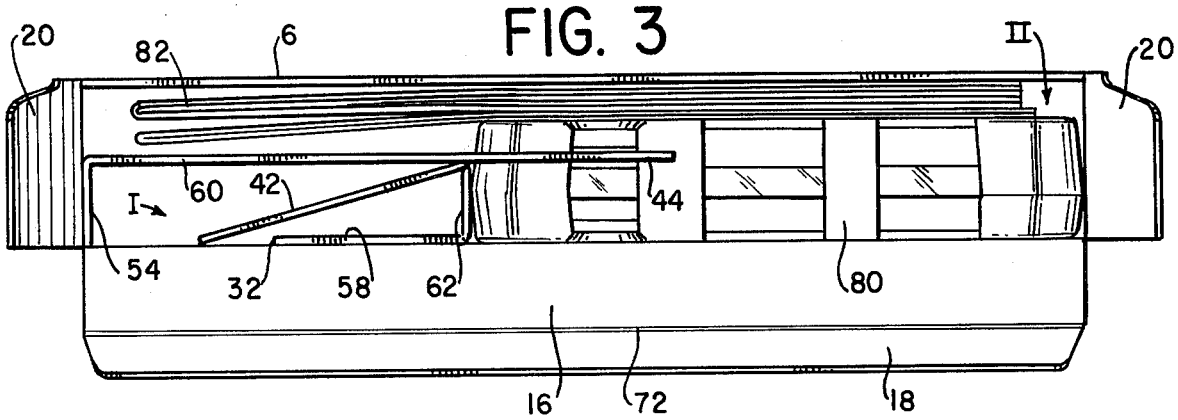

SINGLE SIZE DISPLAY CARTON FOR PACKAGING EITHER A TAPE CASSETTE OR TAPE CARTRIDGE

BACKGROUND OF THE INVENTION

The present invention relates to packaging cartons, and is concerned particularly with points of sale cartons for small rectangular objects such as tape cassettes and 8-track tape cartridges.

Pre-recorded and blank tape cassettes and 8-track tape cartridges are marketed generally in packages only slightly larger than the exterior dimensions of the tape unit or in elongated cartons with windows which permit visual inspection of the cassette or cartridge packaged within the carton. These elongated cartons, commonly referred to as "spaghetti boxes" in the trade, which typically may include a vertical inner wall within the carton to prevent movement of a packaged casette in a first horizontal direction and an edge surface within the carton positioned beneath a cassette or cartridge to prevent movement of the packaged cassette or cartridge in a second horizontal direction. Both of these packages are disadvantageous for a number of reasons.

First, the small packages are highly susceptible to pilferage. See, for example, "The Pilferage Report," published in 1977 by GRT Corporation, 1286 N. Laurence Station Road, Sunnydale, Calif. 94086, a condensation of 200 page study regarding pilferage of prerecorded tape cartridges and cassettes. Accordingly, it has been common in the trade to store tape selections, particularly the smaller type cassettes, behind locked glass panels. Additionally, and perhaps more importantly, sales are not realized because potential customers do not have ready access to the tape selection and are not free to browse. As a result, marketing costs are increased because of the need for sales personnel to assist customers who wish to purchase tape selections in the locked cabinets. In contrast, sales of record albums are more successful because potential customers are free to examine the record album selections and react to art work and other information printed on the record album containers.

A second problem is that packages for tape cartridges and cassettes are too small to include a significant portion of the art work and informational material such as producers and secondary artists (commonly called "credits") normally appearing on record album containers. At best, the artwork on cassette and cartridge packages heretofore available was a sub-miniature of the artwork on the corresponding album and was sometimes barely legible.

A third problem is that record album containers in many cases include bulk material such as librettos, artists' posters, lyric sheets or illustrated booklet accompanying the record. These materials are typically not included in the packages heretofore used for tape cartridges or cassettes. Therefore, cassette and cartridge purchasers receive less than record purchasers. In order to alleviate this problem, record companies have, in many instances, undertaken to provide insert cards with cassettes and cartridges so that purchasers can order these materials. The fulfillment cost of handling and mailing, usually supplied with the records directly from the record company increases the cost of the record companies of marketing cassettes and cartridges.

Another serious problem in the packaging of tape cartridges or cassettes is the lack of uniformity of carton size. Tape cartridges and cassettes are usually packaged in different size cartons. This results in increased handling and shipping costs for the record companies and requires separate inventories to be kept for cassette packages and cartridge packages.

A serious problem with the "spaghetti boxes" referred to above is that the boxes are not selection oriented; that is, they usually do not provide any artwork on the box which distinguishes the box containing a particular cassette or cartridge from another box containing a different cartridge or cassette. Thus, the "spaghetti box" packages also limit the marketing of cassettes and cartridges.

Accordingly, it is the primary object of the present invention to provide a carton of uniform size made from a single piece carton blank which is adapted to contain either a tape cartridge or tape cassette and which is sufficiently large to lessen the likelihood of pilferage.

It is another object of this invention to provide a selection-oriented carton for packaging a cassette or a cartridge on which the same artwork appearing on the front and back of the corresponding record packages appears on the front and back panels of the carton, reduced only slighly in size; and further, a carton which can be embossed, pebbled, laminated or gold stamped and generally receive the same surface treatment as corresponding record albums.

A further object is to provide a carton for the packaging of a tape cassette or cartridge which is sufficiently large to contain the same bulk material such as posters, lyric sheets, and the like, which are contained within record packages and, also, such collateral material as tape cleaners and catalogs.

Another object of this invention is to provide a carton for packaging cassettes and cartridges that can accept a machine readable Universal Product Code and that can be machine loaded with a cartridge or cassette.

SUMMARY OF THE INVENTION

These and other objects are obtained by providing a conventional outer carton formed of top, bottom, side and end walls, and an inner carton portion including an inner vertical wall adapted to prevent movement of a cassette or cartridge in a first horizontal direction, and tab elements providing a retaining surface adapted to prevent movement of the cassette or cartridge in a second horizontal direction. An inner horizontal wall is also provided to prevent movement of a packaged cassette in a vertical direction.

Preferably, the inner carton is formed by a flap hingedly connected to an outer wall. The flap is first folded horizontally and then folded 90° to provide an inner vertical wall, thereby dividing the carton into first compartment below the inner horizontal wall and a second compartment on the other side of the vertical wall from the first compartment. A tab is formed at one end of the inner vertical wall. The first tab is positioned at an end of the first compartment so that the edge of the tab forms the retaining surface for the packaged object, such as a tape cassette. Preferably, a second tab is formed at the end of the inner vertical wall next to the first tab. The second tab extends into the second compartment, so that its edge provides a retaining surface for the packaged object, such as a tape cartridge.

BRIEF DESCRIPTION OF THE DRAWINGS

In describing certain embodiments of the present invention, reference is made to the appended drawings in which:

FIG. 1 is a plan view of a non-erected carton blank, showing the intended fold lines;

FIG. 2 is an enlarged view of the underside of the flap shown in FIG. 1;

FIG. 3 is a side elevational view of the erected carton shown unerected in FIG. 1 and which contains a tape cartridge and a poster;

DESCRIPTION OF A PREFERRED EMBODIMENT

Figure 4:
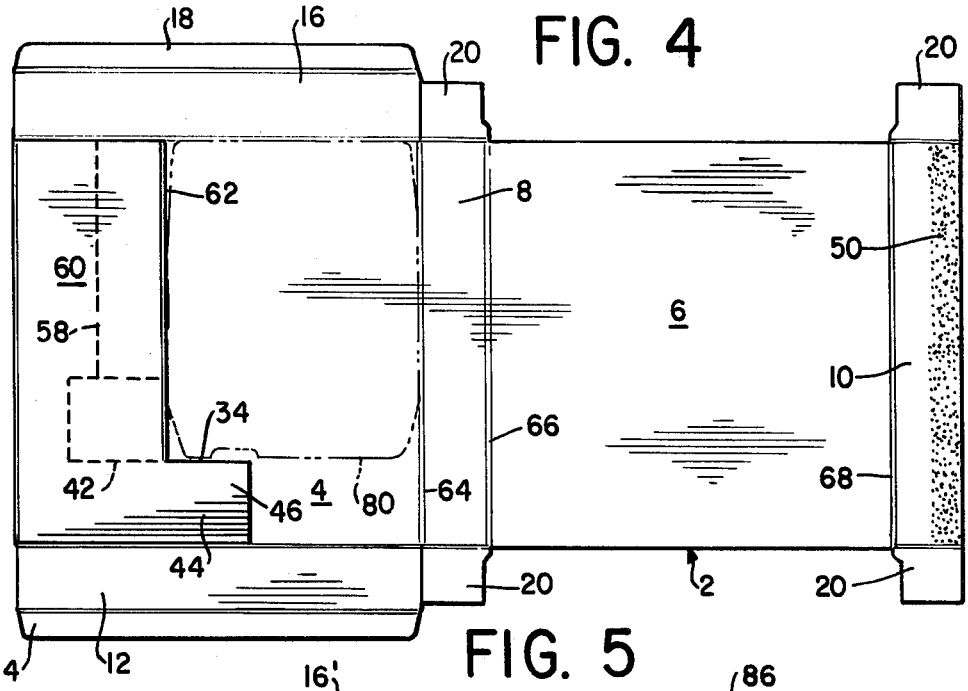
FIG. 4 is a plan view of the partially erected carton blank illustrated unerected in FIG. 1.

FIG. 1 shows a carton blank 2 embodying the present invention and adapted for conventional straight tuck closure. Carton blank 2 includes a top wall 4, bottom wall 6, a pair of side walls 8 and 10, end wall 12 with a flap portion 14, end wall 16 with a flap portion 18, and closure tabs 20.

A flap 22 extends laterally from and is integral with the supporting top wall 4, but separated therefrom by a scoreline 24. In the Figures, the supporting wall is illustratively shown as top wall 4, but it will be understood that other walls may be employed as the supporting wall. A second scoreline 26 is parallel to and spaced laterally outwardly of scoreline 24 and preferably separated therefrom by a distance equal to the height of a tape cassette. A scoreline 28 is parallel to and positioned laterally outwardly of scoreline 26 and separated therefrom preferably by a distance equal to the width $W_1$ of a tape cassette. A scoreline 30 is parallel to and positioned laterally outwardly of scoreline 28 and separated therefrom preferably by a distance equal to the height of a tape cassette. Laterally outwardly from and parallel to scoreline 30 is the edge 32 of flap 22.

The inner carton portion scorelines 24, 26, 28 and 30 may be partially cut or perforated scorelines in order to facilitate erection of the carton.

The width of flap 22 is predetermined so that the width $W_1$, together with the width $W_2$ of a tape cartridge, is approximately equal to the width of top wall 4.

A cut scoreline 34 extends perpendicularly from edge 32 partially into flap 22 towards the supporting top wall 4, preferably, cutline 34 extends from edge 32 at least to scoreline 28. A second cut scoreline 36 extends perpendicularly from edge 32 the same distance as cutline 34. In the preferred embodiment cut scorelines 34 and 36 are both parallel to edges 38 and 40 of flap 22. Preferably, cut scoreline 34 is separated from edge 40 by a distance equal to the length $L_1$ of a tape cassette, while cut scoreline 36 is separated from edge 40 by a distance equal to the length $L_2$ of a tape cartridge. Cut scorelines 34 and 36 and a portion of edge 32 form three sides of a first tab 42 hingedly connected to flap 22 along scoreline 28. A second tab 44 adjacent tab 42 is defined by cutline 36, edge 38 and edge 46 of flap 22. As shown in FIG. 1, edge 46 need not be colinear with edge 32, and may be positioned laterally inwardly or outwardly therefrom. However, to aid in erecting the carton blank, it is preferable that edge 46 be either colinear or positioned laterally inwardly from edge 32 of flap 22.

As shown in FIG. 1, a portion of end wall 10 may be coated with glue or paste 50 which, preferably, should extend laterally inwardly from the outside edge 52 of end wall 10 a distance no greater than the distance separating scorelines 24 and 26. Alternatively, glue or paste 50 may be placed on the underside of wall 54 defined by scorelines 24 and 26 and edges 38 and 40. Additionally, glue or paste 56 is placed on the underside of wall 58 which is defined by edge 32, cutline 34, scoreline 30 and edge 40 of flap 22, as seen in FIG. 2.

Flap 22 is bent at right angles at scorelines 24, 26, 28 and 30 to form a first compartment where wall 54 is vertical, wall 60 (which is defined by edge 40, scoreline 26, edge 38, and tab 46) is horizontal, inside wall 62 (which is defined by edge 40, scoreline 30, cutline 34 and scoreline 28) is vertical, and wall 58 (defined by scoreline 30, edges 40 and 32, and cut scoreline 34) contacts and becomes secured to top wall 4 by glue 56. Thus, flap 22 is folded onto top wall 4 to provide an inner vertical wall 62 and an inner horizontal wall 60 which defines a compartment approximately equal in size to a tape cassette.

The carton is completed by folding carton blank 2 at right angles at the scoreline 64 separating top wall 4 from end wall 8, again at a right angle at scoreline 66 separating end wall 8 from bottom wall 6, and again at scoreline 68 separating bottom wall 6 from end wall 10. Closure tabs 20 may be folded at right angles with respect to end walls 8 amd 10. Front wall 12 may be folded at scoreline 70, and front flap portion 14 may be folded at scoreline 72 so that the flap portion 14 can be positioned inside the outer carton formed by the carton blank. Similarly, rear wall 16 and rear flap portion 18 may be folded respectively at scorelines 74 and 76 for closure.

When erected, carton block 2 illustrated in FIG. 1 is adapted to hold a standard size tape cassette in one compartment or a standard size 8-track tape cartridge in a second compartment, or both, if desired. Tab 42 is positioned at an angle with respect to each of inner horizontal wall 60 and inner vertical wall 62. Accordingly, a cassette may enter this first compartment, designated I in FIG. 3, from the opening of the carton near rear wall 16 until its leading edge meets the edge of tab 42 formed by cut 34 which, as mentioned above, is located from edge 40 a distance equal to the length $L_1$ of the tape cassette. Thus, the cassette will be secure from movement in all directions.

Alternatively, a tape cartridge 80 may be inserted into the second compartment, designated II in FIG. 3, from the same opening of the outer carton at rear wall 16 before closure thereof. As mentioned above, the distance from inside wall 62 to end wall 8 is approximately equal to the width $W_2$ of the tape cartridge. The tape cartridge 80 may enter the second compartment until it reaches the edge of tab 46, which is located, as mentioned above, a distance from edge 40 approximately equal to the length $L_2$ of the tape cartridge 80. As shown in FIG. 3, tab 46 is coplanar with horizontal wall 60. Alternatively, tab 44 may be slightly angled with respect to horizontal wall 60, as shown in phantom in FIG. 3. Tab 44 may also be angled along its length, if desired. Thus, the cartridge is secured from movement in all directions.

In the preferred embodiment, the height of end walls 8 and 10 slightly exceed the height of the tape cartridge 80, so that a folded poster 82 may be inserted between tape cartridge 80 and bottom wall 6. If no bulk material is to be inserted in the carton, the height of the side walls 8 and 10 can be adjusted to be approximately the height of a standard cartridge so that the cartridge is secured from vertical movement.

Figure 5:
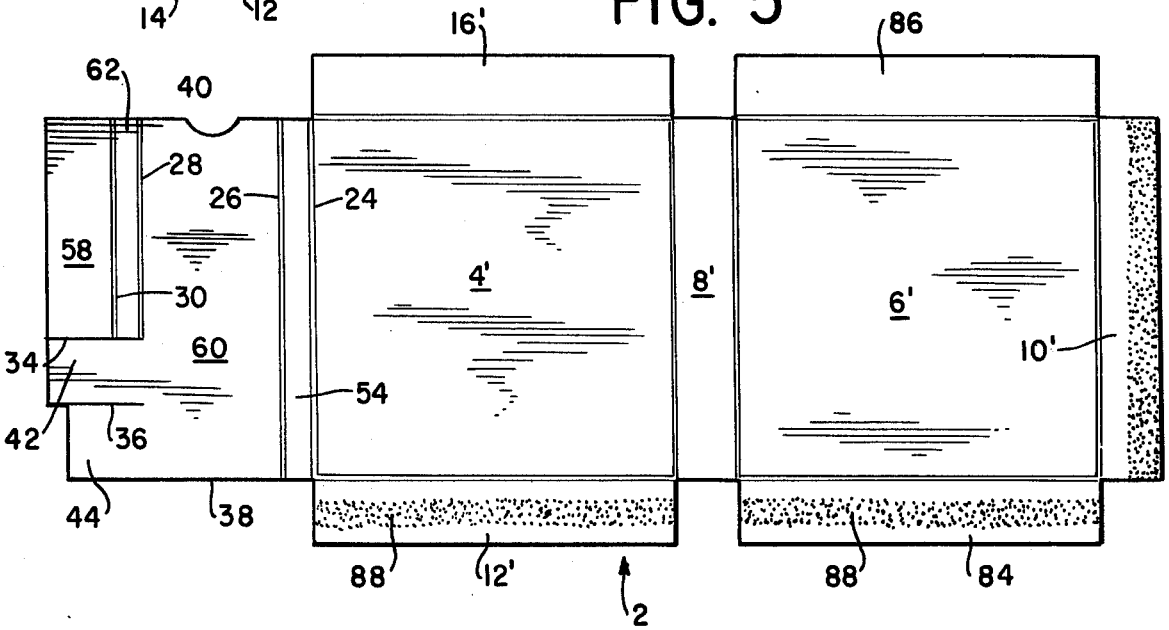
FIG. 5 is a plan view of a carton blank embodying the present invention and using an alternate closure means for the outside carton.

Alternative embodiments for the outer carton may be used. For example, FIG. 5 shows a carton blank 2 which includes a top wall 4', side wall 8', bottom wall 6', side wall 10', end walls 12' and 16'. Instead of closure tabs 20 and end flap portions 14 and 18 respectively as in the preferred embodiment, the embodiment shown in FIG. 5 includes panels 84 and 86, each adjacent to end walls 12' and 16', repectively, but separated therefrom by side wall 8'. Both end walls 12' and 16' include a coating of glue 88 on the inside surfaces thereof, so that after panels 84 and 86 are folded at right angles with respect to bottom wall 6', walls 12' and 16° respectively may be folded thereover so that the glue 88 contacts the outside surfaces of panels 84 and 86 to secure walls 12' and 16' respectively thereto.

The outer carton of FIG. 1 can also utilize a reverse tuck closure by positioning one of the walls 12 or 16 on bottom wall 6 rather than top wall 4, and by reversing the direction of taper of closure tabs 20 adjacent the repositioned wall. Other modifications may be made within the scope of the prior art.

Figure 6:
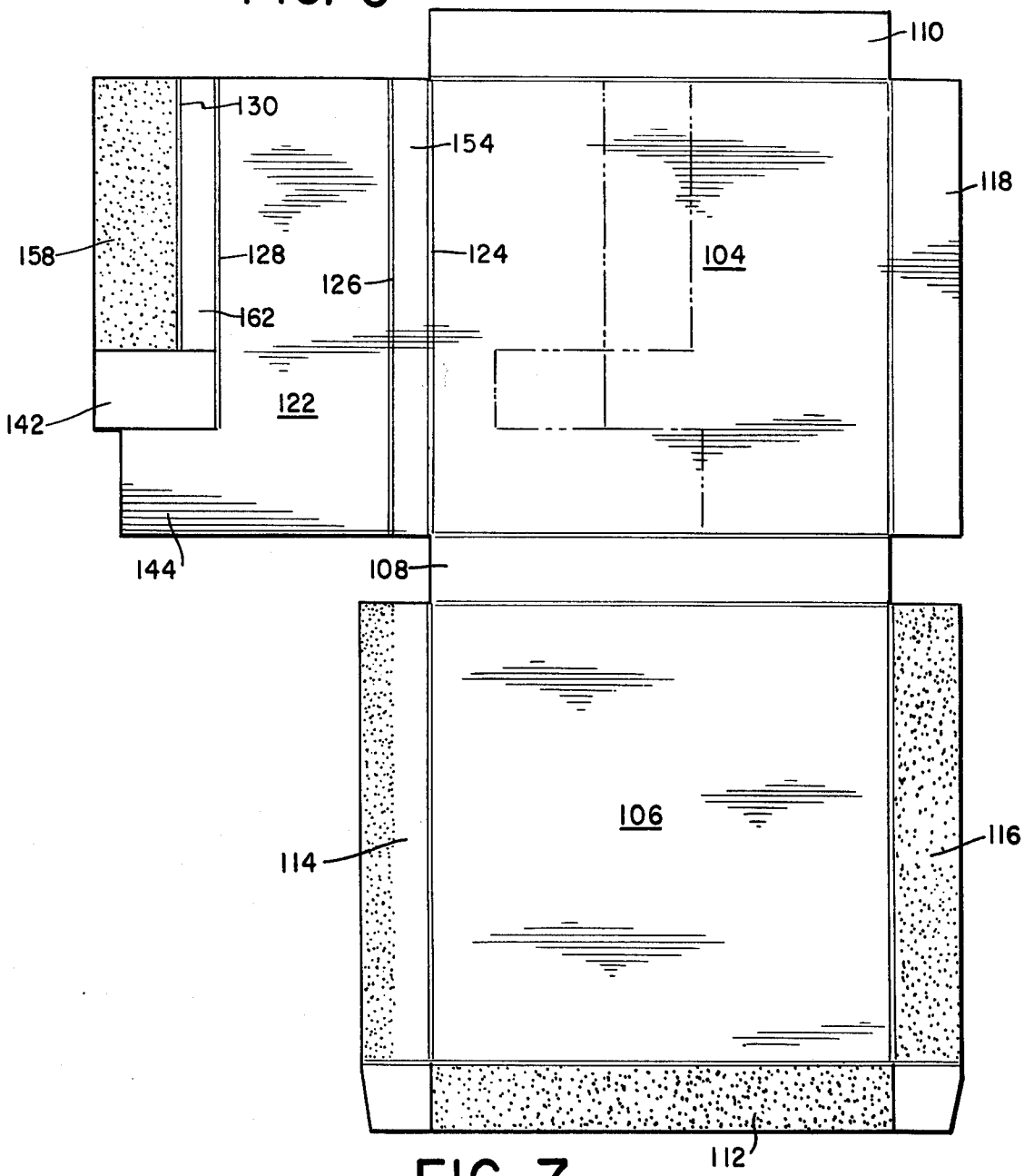
FIG. 6 is a plan view of a non-erected carton blank which is an alternate embodiment of my invention, showing the intended fold lines.
Figure 7:
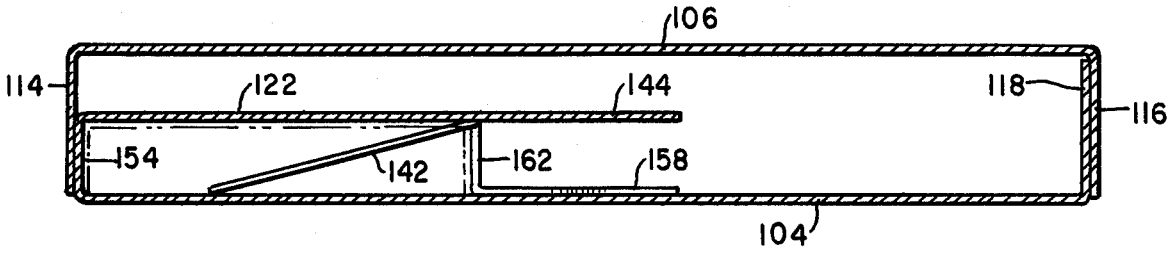
FIG. 7 is a cross-sectional view of the erected carton shown unerected in FIG. 6.

FIGS. 6 and 7 illustrate yet another alternate embodiment of my invention. This embodiment consists of top and bottom walls 104 and 106 hingedly connected to one another along a sidewall 108. End flaps 110 and 112 are hingedly connected to the top wall and bottom wall, respectively. Side flaps 114 and 116 are hingedly connected to bottom wall 106 and side flap 118 is hingedly connected to one side of top wall 104. Flap 122 is substantially similar to flap 22 described above with respect to the preferred embodiment. Flap 122 is hingedly connected to top wall 104 along scoreline 124. Scoreline 126 is spaced outwardly from scoreline 124. Wall 154 is formed between scorelines 124 and 126. Spaced outwardly from scoreline 126 is scoreline 128 and spaced further outwardly is scoreline 130. The area between scorelines 128 and 130 defines wall 162 which comprises the inner vertical wall of the carton. Flap 158 is hingedly connected to wall 162 along scoreline 130.

In this embodiment, flap 158 is adapted to be glued to the portion of the top wall 104 which comprises the second compartment rather than to the portion of the top wall which comprises the first compartment as in the first embodiment. Obviously, flap 158 can be glued inwardly or outwardly with respect to the second compartment. The gluing of flap 158 to top wall 104 is shown in phantom in FIG. 6.

Tabs 142 and 144 formed on flap 122 in the same manner as in the first embodiment described above. As shown in phantom in FIG. 6, tab 142 is adapted to extend inwardly towards the second compartment which is adapted to retain a cassette and tab 144 extends inwardly towards the first compartment which is adapted to retain a tape cartridge.

In the erected carton, as illustrated in FIG. 7, the glue flaps 116 and 114 of the bottom wall 106 are glued to the outwardly facing surfaces of flaps 118 and 154 of top wall 104. Similarly, flap 112 of bottom wall 106 is glued to the outwardly facing surface of top wall flap 110.

The various elements of this embodiment which have not been described are similar to and operate in the same manner as the correspondingly numbered elements described above with respect to the FIG. 1 embodiment.

It will be seen from the foregoing description that flap 22 provides inner vertical and horizontal walls adapted to prevent movement of a contained tape cassette or tape cartridge in a first or lateral, horizontal direction, and movement of a packaged cassette in a vertical direction, and that the edges of tabs 42 and 46, when properly positioned, provide a retaining surface to prevent movement of the cassette or tape cartridge in a second or longitudinal, horizontal direction.

It will be apparent to those skilled in the art that other equivalent arrangements may be devised utilizing the present invention, and it is therefore preferred that this disclosure be taken in an illustrative sense and that the scope of protection accorded to the present invention be defined by the appended claims.

What is claimed is:

1. A uniform size carton for packaging either a tape cassette or tape cartridge comprising:

an outer carton consisting of top, bottom, front, rear and side walls, the length of said outer carton being at least as great as the length of a standard tape cartridge and the width of said outer carton being at least as great as the combined width of a standard tape cartridge and a standard tape cassette;

an inner carton portion including a vertically extending inner wall, the height of said vertically extending inner wall being at least as great as the thickness of a standard tape cassette, the length of said vertical inner wall being substantially the length of a standard tape cassette, said vertically extending inner wall being spaced from said outer carton side wall a distance approximately equal to the width of a standard tape cassette; a continuous horizontally extending inner wall being spaced from said outer carton bottom wall a distance approximately equal to the thickness of a standard tape cassette, the width of said horizontally extending inner wall being approximately equal to the width of a standard tape cassette; an inner side wall hingedly interconnecting said bottom wall and said horizontal inner wall; said vertically extending inner wall, said horizontally extending inner wall, said inner side wall and a portion of said bottom wall forming a first compartment for a standard tape cassette for preventing substantial movement of a packaged tape cassette in a vertical plane and in a first or lateral horizontal plane;

means for preventing substantial movement of a tape cassette packaged in the tape cassette carton in a second horizontal plane, said preventing means being located within said outer carton and being spaced from said outer carton front wall a distance at least as great as the length of a standard tape cassette, said preventing means being aligned with said tape cassette compartment.

2. The carton defined in claim 1 wherein said preventing means comprises a tab hingedly connected to said horizontally extending inner wall and extending diagonally from said inner wall so that the side edge of the tab is located at the bottom of the tape cassette compartment.

3. The carton recited in claim 1 wherein said vertically extending inner wall, one of said outer carton side walls and portions of said outer carton top and bottom walls form a second compartment for a standard tape cartridge for preventing substantial movement of a packaged tape cartridge in a vertical plane and in a first or lateral horizontal plane; and further comprising means for preventing substantial movement of a tape cartridge in a second horizontal plane, said preventing means being located within said outer carton and being spaced from said outer carton front wall a distance at least as great as the length of a standard tape cartridge, said preventing means being aligned with said tape cartridge compartment.

4. The carton defined in claim 3 wherein said preventing means comprises a tab hingedly connected to said horizontally extending inner wall and extending from said inner wall so that the side edge of the tab is located at the bottom of the tape cartridge compartment.

5. A uniform size carton for packaging either a tape cassette within a first compartment of the carton or, alternatively, a tape cartridge within a second compartment of the carton, comprising:

top, bottom and side walls adapted to form an outer carton;

an inner carton portion including a vertically extending inner wall, said vertical inner wall extending from said bottom wall a distance less than the height of said side walls; the length of said vertical inner wall being substantially the length of a standard tape cassette, and a continuous, horizontally extending inner wall, said horizontal inner wall being spaced from said bottom wall a distance equal to the height of said vertical inner wall; an inner side wall hingedly interconnecting said bottom wall and said horizontal inner wall;

a first compartment for packaging a tape cassette being formed by said vertical inner wall, said inner horizontal wall, said inner side wall and a portion of said bottom wall;

a second compartment for packaging a tape cartridge being formed by said vertical inner wall, one of said outer walls and portions of said top and bottom walls;

a first tab element positioned adjacent said vertical inner wall and extending into said first compartment;

whereby said vertical inner wall, in combination with said inner side wall and said outer side wall, prevents substantial movement in a first horizontal plane of a tape cassette in the first compartment and a tape cartridge in the second compartment; said horizontal inner wall prevents substantial movement in a vertical plane of a tape cassette in the first compartment and said first tab element prevents substantial movement in a second horizontal plane of a tape cassette in the first compartment.

6. The carton according to claim 5 further including a second tab element positioned adjacent said first tab and extending into the second compartment whereby said second tab element prevents substantial movement in a second horizontal plane of a tape cartridge in the second compartment.

7. The carton according to claim 6 wherein said first and second tab elements are hingedly connected to said horizontal inner wall.

8. The carton according to claim 5 wherein said vertically extending inner wall is hingedly connected to said horizontally extending inner wall.

* * * * *